United States Patent [19]

Genovese et al.

[11] 4,201,436

[45] May 6, 1980

[54] MINIATURE MATRIX ASSEMBLY

[75] Inventors: David L. Genovese, Spring Valley; Miklos Madarasz, Bedford, both of N.Y.

[73] Assignee: Sealectro Corporation, Mamaroneck, N.Y.

[21] Appl. No.: 942,347

[22] Filed: Sep. 14, 1978

[51] Int. Cl.[2] ..... H01R 9/08

[52] U.S. Cl. ..... 339/96; 339/18 P

[58] Field of Search ..... 339/18 C, 18 P, 96, 339/97 R, 97 P, 98, 99 R, 176 MF

[56] References Cited

U.S. PATENT DOCUMENTS

| | | | |
|---|---|---|---|
| 3,021,498 | 2/1962 | Spillar | 339/18 C |
| 3,133,773 | 5/1964 | Ecker | 339/96 |
| 3,154,363 | 10/1964 | Will | 339/99 R |
| 3,189,863 | 6/1965 | Leach | 339/176 MF |
| 3,573,713 | 4/1971 | Enright et al. | 339/98 |
| 3,816,818 | 6/1974 | Meier | 339/99 R |

FOREIGN PATENT DOCUMENTS

| | | | |
|---|---|---|---|
| 585180 | 1/1934 | Fed. Rep. of Germany | 339/97 P |
| 2031215 | 12/1971 | Fed. Rep. of Germany | 339/98 |

*Primary Examiner*—Joseph H. McGlynn
*Attorney, Agent, or Firm*—Anthony J. Casella

[57] ABSTRACT

A programmable matrix assembly which includes two flat cables having their longitudinal axis perpendicular to each other. First and second cover plates, one of which has two sets of holes, which are spaced in staggered relationship. Conducting connecting pins insertable into the holes and then through the insulation and the conductors for electrically interconnecting selected conductors of the flat cables.

4 Claims, 6 Drawing Figures

MINIATURE MATRIX ASSEMBLY

BACKGROUND OF THE INVENTION

The subject invention relates to miniature matrix boards used in electronic programming, and are particularly applicable in such areas as telephone communication and miniature computers such as are used in aircraft. In essence, programming matrix boards include at least two sets of conductors which are arranged in orthagonal relationship thus providing a plurality of intersecting contact points, the contact points being selectively connected in accordance with a desired program. One known miniature matrix programming board is the patent to Laserson et al, U.S. Pat. No. 4,084,870, issued Apr. 18, 1978 and entitled "Miniature Matrix Programming Board", the assignee of said patent being the same assignee as that of the present invention. While the above recited reference represents a significant improvement over previously known matrix programming boards, further advances in the electronics industry have made it desirable to further miniaturize and increase the density of a programming board. In addition, it is desirable that the need for separate soldering interconnections between termination pins and connecting cable existing with currently known programming boards be minimized so as to reduce interference, background noise, etc.

Accordingly, it is an object of the subject invention to provide a new and improved miniature matrix assembly which provides an increased contact density per unit space and which can be used with standard printed circuit boards.

It is another object of the subject invention to provide a miniature matrix assembly which minimizes the number of separate soldering programming interconnections necessary between the assembly and the other electrical equipment.

It is a further object of the subject invention to provide a miniature programming board having the above described characteristics which is relatively inexpensive to manufacture such that when it is desired to modify a program, the old programming board may be simply discarded for a new one.

SUMMARY OF THE INVENTION

In accordance with the above recited objectives, the miniature matrix programming assembly of the subject invention includes first and second substantially flat conductor cables each of which having a plurality of parallel, elongated conductors embedded in a sheet of resilient, non-electrictively conductive insulation material. Preferably, the insulation material comprises a thermoplastic elastomer such as polybutylene terephthalate or polyethylene terephthalate. Each conductor is formed from a plurality of stranded wires of annular cross-section such that the sheet of insulation material of each cable conforms to the configuration of the conductors to define upper and lower corrugated surfaces of the flat cable when viewed in cross-section. The longitudinal axis of the first conductor cable is disposed perpendicular to the longitudinal axis of the second conductor cable, the first and second conductor cables being in abutting planar relationship, along a surface thereof to define a plurality of columns and rows of conductors and a matrix of cross-over points of the respective conductors. The subject programming assemblies further includes first and second cover plates disposed on the respective opposed surfaces of the first and second flat conductor cables opposite to the abutting contact surfaces thereof. Each of the cover plates is made of an insulative material, preferably a volcanized fiber, and includes a plurality of elongated, parallel grooves formed on one surface thereof for cooperation with the respective corrugated surface configuration of the abutting cable. Each cover plate includes a plurality of programming apertures positioned in alignment with the crossover points of the respective conductors in the first and second flat conductor cables. Preferably, each stranded conductor forming a part of the first and second cables has a spacing on the order of 0.050 inches with the spacing between the cable cros-over points and the programming apertures on the first and second cover plates aligned therewith being equally spaced. In addition, it is preferable that each cover plate include a second set of apertures for terminating said first and second cable members, for receiving termination pins for connecting the outputs of the assembly to other electrical equipment. Preferably, the termination apertures are arranged in two substantially parallel rows, the apertures in each row being spaced from one another a distance on the order of 0.100 inches. The termination apertures are preferably disposed in staggered relationship with an aperture in one row being disposed midway between two apertures in the second row such that the lateral spacing between adjacent apertures in each row is on the order of 0.050 inches.

In order to program the subject assembly, a contact pin is inserted into a selected programming aperture such that the pin pierces through a cable cross-over point establishing contact between a particular column and row of the conductor matrix. As the pin penetrates the cable insulation, the resilient material from which the cable is formed closes around the pin to effect an hermetic seal therearound.

BRIEF DESCRIPTION OF THE FIGURES

Referring to FIGS. 1 and 2 the miniature programming assembly of the subject invention, which is designated generally by reference numeral 5, includes an outer housing member 6 comprising a cover member 10 and a base member 20 which may be suitably fastened together through corner apertures 7. In addition, cover member 10, and base member 20 each includes means for spacing them apart when the housing 6 is assembled, the spacing means typically being a pair of longitudinal shim members 15 and 16 respectively. Housing 6 may be formed from an insulative material such as a molded or machined plastic, but is preferably formed from a vulcanized fiber, such as cardboard. The specific construction of housing 6 will be described in more detail below.

Turning now to FIGS. 1–5, the miniature programming assembly of the subject invention 5 further comprises first and second, substantially flat cable members 30 and 40 which are disposed within housing 6, sandwiched between cover 10 and base 20. While the figures indicate that cable members 30 and 40 have dimensions corresponding to the dimensions of housing 6 it will be understood that typically one end of each cable extends beyond the housing so as to be connected to a power source while the other end of each cable terminates within the housing via termination pins which may be plugged into the programmed equipment. Each cable member 30, 40 comprises a plurality of parallel, elongated conductors 31, 41 which are embedded in a sheet of resilient, non-electrically conductive insulation material 33, 43, such that each conductor is fully insulated from the conductor immediately adjacent thereto. The insulative material from which cables 30 and 40 are formed may be a soft, resilient rubber-like material, but is preferably a thermoplastic elastomer which has a high heat resistance such as polybutylene terephthalate or polyethylene terephthalate. In accordance with the subject invention each conductor 31, 41 comprises a plurality of stranded wires 32, 42, of annular cross-section such that the sheet of insulation material 33, 43 conforms to the configuration of said conductors to define upper corrugated surfaces 34, 44 and lower corrugated surfaces 35, 45, of the flat cable when viewed in cross-section (see FIGS. 3 and 6). Thus, each cable member 40, 40 includes a plurality of valleys 36, 46 defined by the insulation material, spacing each conductor 31, 41, and a plurality of ridges 37, 47 defined by the insulation material enclosing each conductor. It should be noted that further to the above-recited objective of further miniaturizing the subject matrix board as compared to known devices the spacing between the respective conductors 31, 41 on each cable member is preferably on the order of 0.050 inches. As illustrated most clearly in FIGS. 2 and 6, cable members 30 and 40 are disposed within housing 6 in abutting planar relationship, and in an orientation such that the conductors 31 of cable 30 are disposed perpendicular to conductors 41 of cable 40. Thus there are defined a plurality of perpendicular columns and rows of conductors having cross-over or intersection points 50 at which a selected conductor row 31 of cable 30 may be electrically connected to a desired conductor column 41 of cable 40. In accordance with the subject invention, cross-over points 50 are preferably spaced apart from one another a distance on the order of 0.050 inches.

Figure 1:
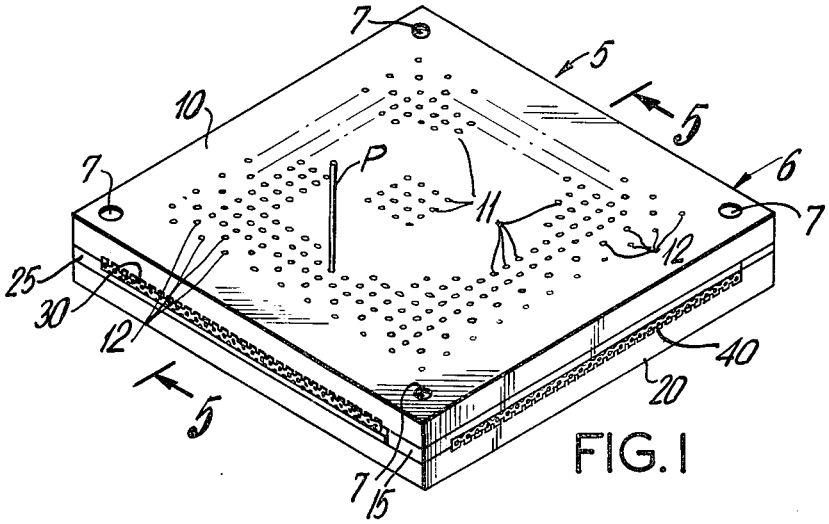
FIG. 1 is a perspective view of the programming assembly of the subject invention.
Figure 2:
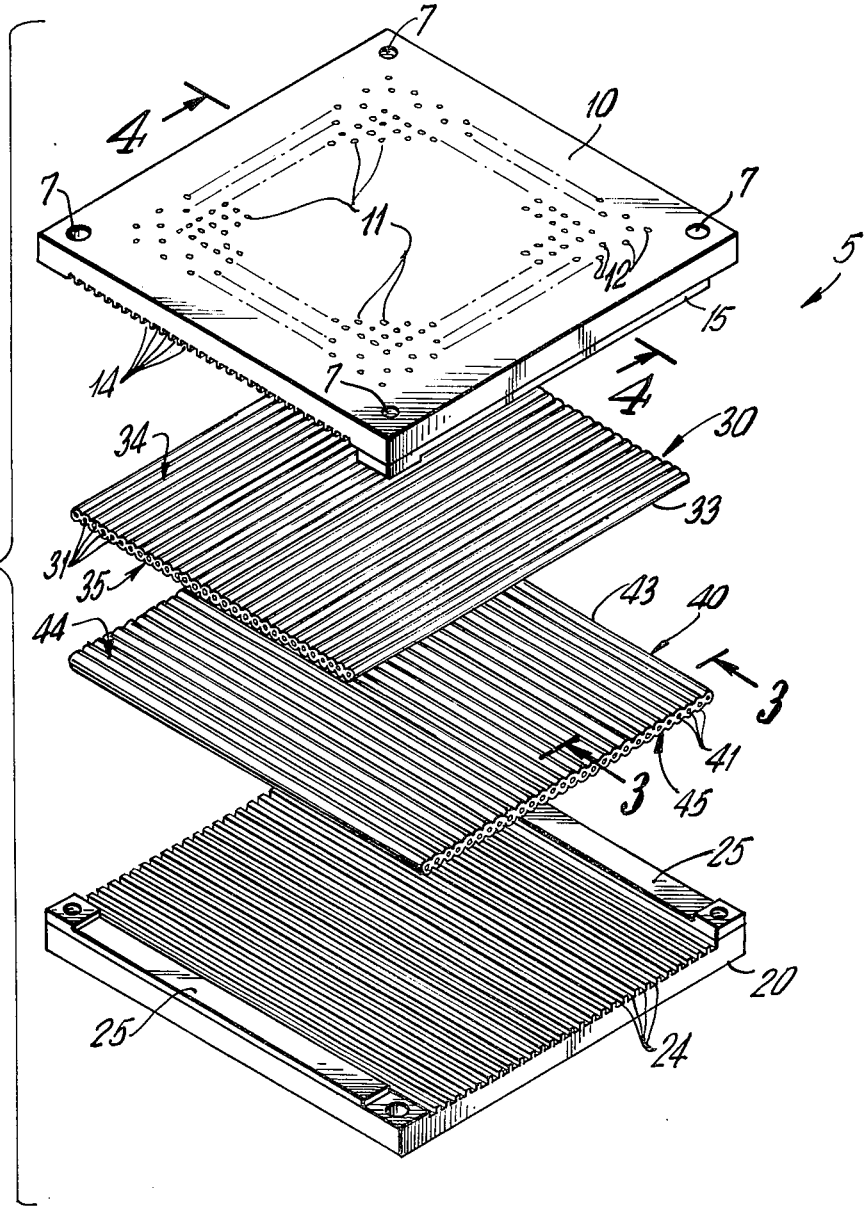
FIG. 2 is an exploded perspective view of the programming assembly of the subject invention.
Figure 3:
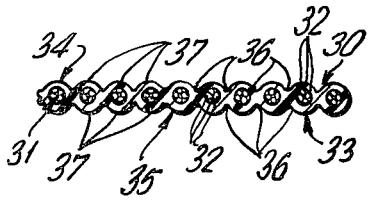
FIG. 3 is a cross-sectional view of the programming assembly of the subject invention taken along line 3—3 of FIG. 2.
Figure 4:
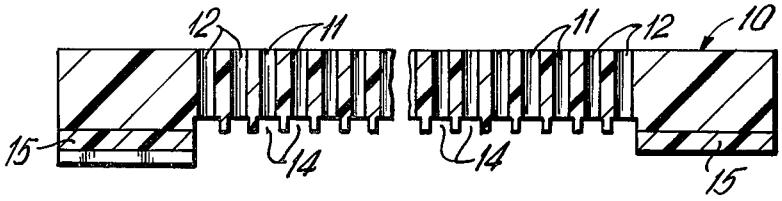
FIG. 4 is a cross-sectional view, broken away in part, of the programming assembly of the subject invention taken along line 4—4 of FIG. 2.

Turning again to the construction of housing 6, which sandwiches cables 30 and 40, and specifically to FIGS. 1–2, and 4–6, it will be noted that the inside surface of cover plate 10 and base plate 20 includes a plurality of grooves 14 and 24, respectively, each groove being preferably spaced from the next a distance on the order of 0.050 inches. While cover plate 10 and base 20 are typically identical in construction they are oriented such that the grooves of each are parallel to the respective orthagonally disposed cable members abutting there against. Thus, grooves 14 of cover plate 10 are parallel with conductors 31 of cable 30, and grooves 24 are parallel with conductors 41 of cable 40. The respective corrugated ridges 37, 47 of the cables 30 and 40 are seated in the grooves 14 and 24 respectively so as to prevent slippage of of the cables within the housing and to insure the proper formation of cross-over points 50.

Further referring to the figures, cover member 10 includes two sets of apertures, namely, a set of programming apertures 11, and a set of termination apertures 12. In accordance with the subject invention, programming apertures 11 are preferably spaced from one another a distance on the order of 0.050 inches, and are each disposed in alignment with a matrix cross-over point 50 (see FIGS. 5 and 6). Apertures 11 may be typically drilled through cover plate 10 with the precise number and location thereof being determined by the particular program desired. In operation, an electrically conductive programming pin P is inserted into a programming aperture 11 so as to pierce through cables 30 and 40 at a desired crossover point 50, thus establishing electrical contact between a specific pair of intersecting conductors 31 and 41 of said cables. As indicated above, the provision of grooves 14 and 24 on cover and base plates 10 and 20, respectively insures the proper alignment of programming apertures 11 with crossover points 50. The stranded construction of conductors 31, 41 enables the pin P to be firmly received between conductor strands, thus virtually assuring proper electrical contact and minimizing the risk that the pin will miss or only glance a conductor upon penetrating the cables. Further, because of the resilience of the particular material used as the cable insulation, 33 and 43, the insulation tightly closes around the pin (see FIG. 6) upon insertion to effect a hermetic seal which minimizes possible interference.

Figure 5:
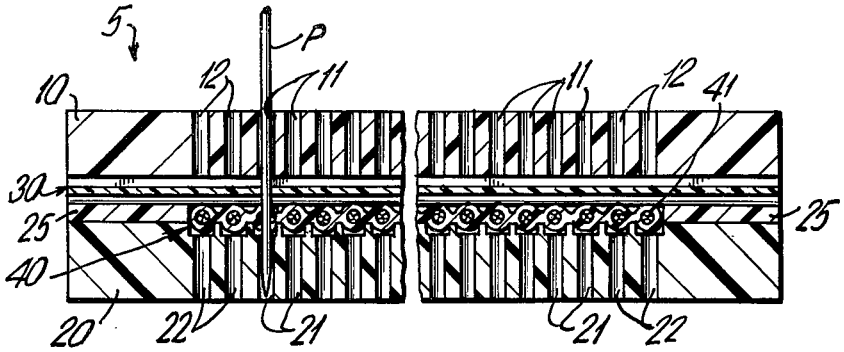
FIG. 5 is a cross-sectional view, broken away in part, of the programming assembly of the subject invention taken along line 5—5 of FIG. 1.
Figure 6:
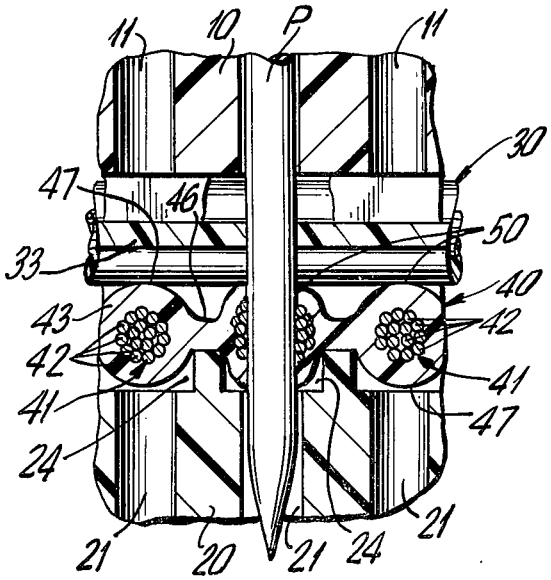
FIG. 6 is an enlarged cross-sectional view of the programming assembly of the subject invention taken along a portion of FIG. 5.

It will be noted that as illustrated in FIGS. 5 and 6, base member 20 may also include a plurality of programming apertures 21 which are aligned with programming apertures 11 of cover member 10. This enables the pin P to fully penetrate the assembly 5 such that the lead end of the pin may be deformed against the outer surface of base member 20 to effect a permanent connection.

Referring again to FIGS. 1 and 2, cover member 10 of the subject assembly includes a second set of apertures, namely, termination apertures 12. Termination apertures 12 receive termination pins (not shown) for connecting the outputs of the subject programming assembly to the programmed equipment which typically includes printed circuit boards. Thus, termination apertures 12 must be spaced so as to align with the cable crossover points 50 (which are spaced from one another a distance on the order of 0.050 inches) as well as to match the standard connecting holes of a printed circuit board (the minimum standard spacing of which is on the order of 0.100 inches). In order to effect his matching, termination apertures 12 are arranged in two rows around cover member 10 and base member 20, in staggered relationship, with each aperture 12 of one row being disposed midway between two apertures of the other row. Thus, the apertures in each row are spaced 0.100 inches from one another to match the connection holes of a printed circuit board while the apertures between each row are laterally spaced from one another 0.050 inches to match up with the cable cross-over points.

In summary, the subject invention provides a new and improved miniature programming assembly which has a substantially increased programming density over known devices and is quite inexpensive to manufacture. The specific structure of the subject invention provides a device which is simple in construction yet very reliable, the chances of improper alignment of conductors and/or improper electrical contact being substantially reduced. The extent of the programming matrix is solely dependent on the number of standard conductors in the flat cable members. The provision of cable members as an actual part of the programming matrix minimizes the number of soldered interconnections necessary thus reducing interference, background noise, etc.

While there have been described herein what are at present considered preferred embodiments of the invention, it will be obvious to those skilled in the art that many modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. A miniature matrix assembly comprising:

first and second substantially flat-conductor cables each including a plurality of parallel, elongated conductors embedded in a sheet of resilient electrically non-conductive insulation material such that each conductor is fully insulated from the conductor adjacent thereto, the conductors of each cable being spaced at 0.050 inch intervals, each conductor being a stranded wire of annular cross-section such that the sheet of insulation material conforms to the configuration of said conductors to define upper and lower corrugated surfaces of the flat cable having ridges and valleys when viewed in cross-section, the longitudinal axis of said second flat conductor cable being disposed perpendicular to the longitudinal axis of said first flat conductor cable, said first and second flat conductor cables being in abutting planar relationship along a surface thereof to define a matrix of cross-over points of the respective conductors;

first and second cover plates disposed on the respective opposed surface of said first and second flat conductor cables opposite to said abutting contact surfaces thereof, each said cover plate being made of an insulative material and including a plurality of elongated, parallel grooves formed on one surface thereof for cooperation with the respective corrugated surface configuration of the abutting cables, such that the ridges of said cables are seated within said grooves, each of said cover plates being formed with a plurality of programming holes spaced at 0.050 inch intervals and positioned in alignment with the cross-over points of the respective conductors in the first and second flat conductor cables, each of said first and second cover plates further including a plurality of termination apertures spaced in staggered relationship at 0.100 inch intervals such that a plurality of termination apertures is provided at 0.050 intervals; and fastening means for holding said first and second cover plates, and the first and second flat conductor cables sandwiched therebetween in fixed relationship for receiving conducting connecting pins inserted through the programming holes in the first cover plate and then through the insulation and stranded conductors of said first and second conductor cables, for electrically interconnecting selected intersecting conductors of said first and second flat conductor cables, the insulation material of said cables effecting an hermetic seal around said pin upon insertion thereof.

2. A miniature matrix assembly as in claim 1 wherein said first and second cover plates are molded of plastic insulative material.

3. A miniature matrix assembly as in claim 1 wherein said conductors of the first and second flat conductor cable are made of stranded copper-wire.

4. A miniature matrix assembly as in claim 1 wherein said insulation material of said first and second flat conductor cables is polybutylene terephthalate.

* * * * *